US007918459B1

(12) United States Patent
Chiu

(10) Patent No.: US 7,918,459 B1
(45) Date of Patent: Apr. 5, 2011

(54) THROWER FOR GAME MACHINE

(75) Inventor: Tsan-Li Chiu, Shu-Lin (TW)

(73) Assignee: Saint-Fun International Ltd., Taipei Hsien (TW)

( * ) Notice: Subject to any disclaimer, the term of this patent is extended or adjusted under 35 U.S.C. 154(b) by 0 days.

(21) Appl. No.: 12/604,303

(22) Filed: Oct. 22, 2009

(51) Int. Cl.
*A63F 9/02* (2006.01)

(52) U.S. Cl. ..... 273/454; 273/138.2

(58) Field of Classification Search ..... 273/440, 273/454, 138.2, 138.3; 124/4, 6, 7, 16, 36
See application file for complete search history.

(56) References Cited

U.S. PATENT DOCUMENTS 4,496,160 A * 1/1985 Wichinsky et al. ..... 273/369
4,744,566 A * 5/1988 Malavazos et al. ..... 273/357
4,759,551 A * 7/1988 Crompton ..... 273/355
5,342,049 A * 8/1994 Wichinsky et al. ..... 273/119 R
5,501,466 A * 3/1996 Welch et al. ..... 273/355
5,669,607 A * 9/1997 Silver et al. ..... 273/354
5,678,823 A * 10/1997 Chaffee et al. ..... 273/371
5,697,611 A * 12/1997 Kelly et al. ..... 273/126 A
6,109,613 A * 8/2000 Crompton et al. ..... 273/354
6,270,080 B1 * 8/2001 Chang ..... 273/399
6,889,678 B1 * 5/2005 Oltmann ..... 124/7

* cited by examiner

*Primary Examiner* — Raleigh W. Chiu
(74) *Attorney, Agent, or Firm* — Pai Patent & Trademark Law Firm; Chao-Chang David Pai

(57) ABSTRACT

A thrower used in a game machine includes a joystick having a stick and an induction switch spaced below the stick, a thrower holder holding an electromagnetic valve that is controllable by the induction switch to throw an object away from the thrower holder, a tilting bar pivotally coupled between the joystick and the thrower holder and movable by the joystick to bias the thrower holder in Y-axis direction, a swinging bar pivotally coupled between the joystick and a connection frame that is pivotally coupled between the swinging bar and the thrower holder for enabling the swinging bar to bias the thrower holder in X-axis direction according to the control of the joystick.

10 Claims, 10 Drawing Sheets

THROWER FOR GAME MACHINE

BACKGROUND OF THE INVENTION (a) Field of the Invention

The present invention relates to game machines and more particularly, to a thrower for use in a game machine to throw an object in any selected direction.

(b) Description of the Prior Art

Many game machines, such as basketball machine, baseball machine, dartboard game machine, etc., are known for playing a throwing action. When using a throwing game machine, the player must throw the ball or dart by hand. There is also known a throwing game machine in which the player must throw a ball, coin or token to a predetermined location by spring means or the like for a striking action. However, this kind of throwing game machine simply allows throwing of a ball, coin or token in one particular direction or one of a limited number of directions. Because this kind of throwing game machine does not allow adjustment of the throwing angle and direction, it cannot increase the level of difficulty of the game task or enhance the entertainment effect.

SUMMARY OF THE INVENTION

The present invention has been accomplished under the circumstances in view. It is one object of the present invention to provide a thrower for coin-throwing game machine, which allows quick and accurate adjustment of the throwing angle in any direction.

To achieve this and other objects of the present invention, a thrower used in a game machine comprises a joystick, a thrower holder, a tilting bar, a swinging bar and a connection frame. The joystick comprises a stick and a base. The base holds an induction switch at the bottom side thereof. The induction switch is controllable by the stick. The thrower holder holds an electromagnetic valve on the bottom side. The electromagnetic valve is controllable by the induction switch to throw an object away from the thrower holder. The tilting bar is pivotally coupled between the joystick and the thrower holder and movable by the joystick to bias the thrower holder in Y-axis direction. The swinging bar is pivotally coupled between the joystick and the connection frame and movable by the joystick to bias the thrower holder in X-axis direction. The connection frame is pivotally coupled between the swinging bar and the thrower holder.

DETAILED DESCRIPTION OF THE PREFERRED EMBODIMENTS

Figure 1:
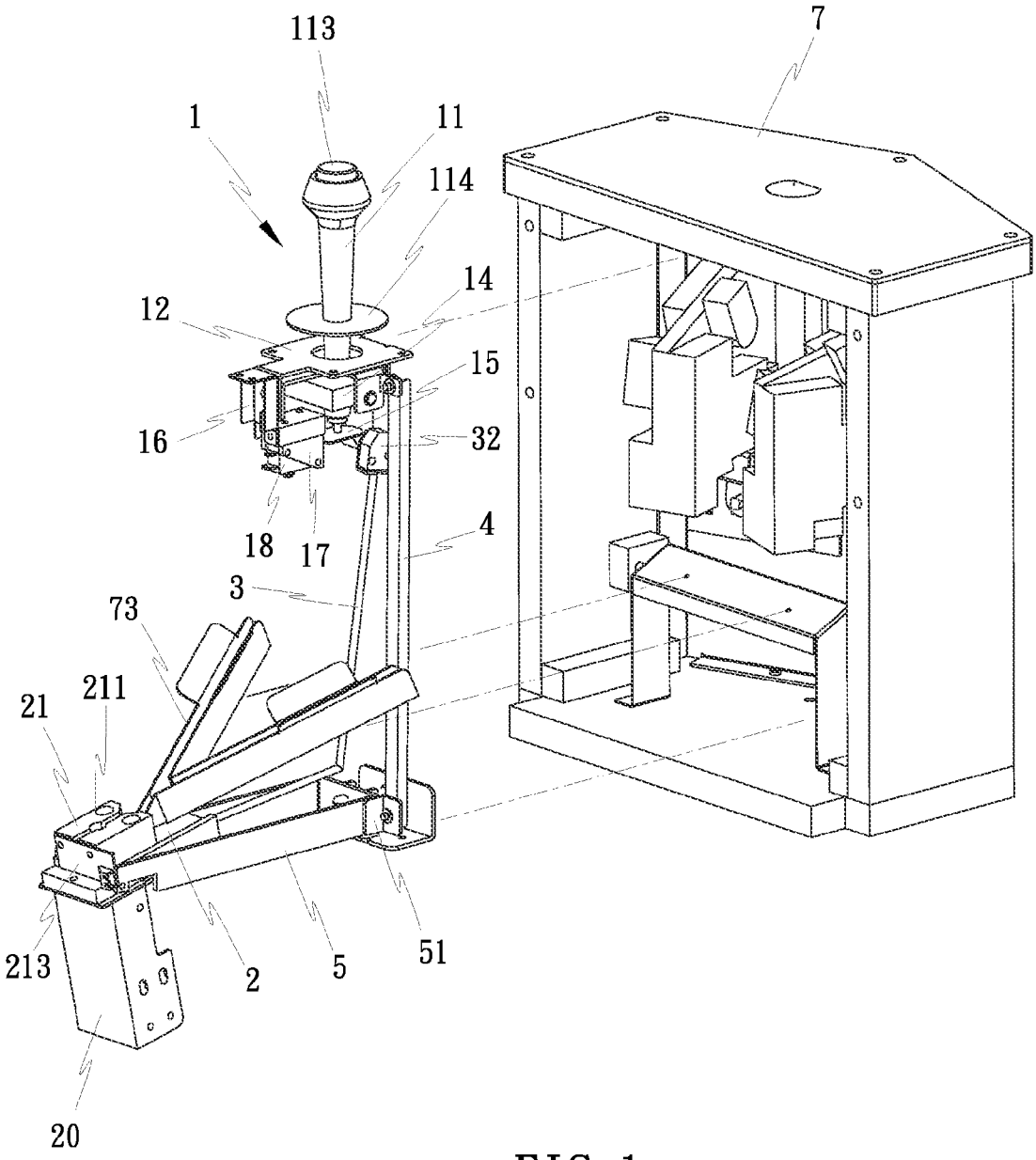
FIG. 1 is an exploded view of a thrower and a housing for a coin-throwing game machine according to the present invention.
Figure 2:
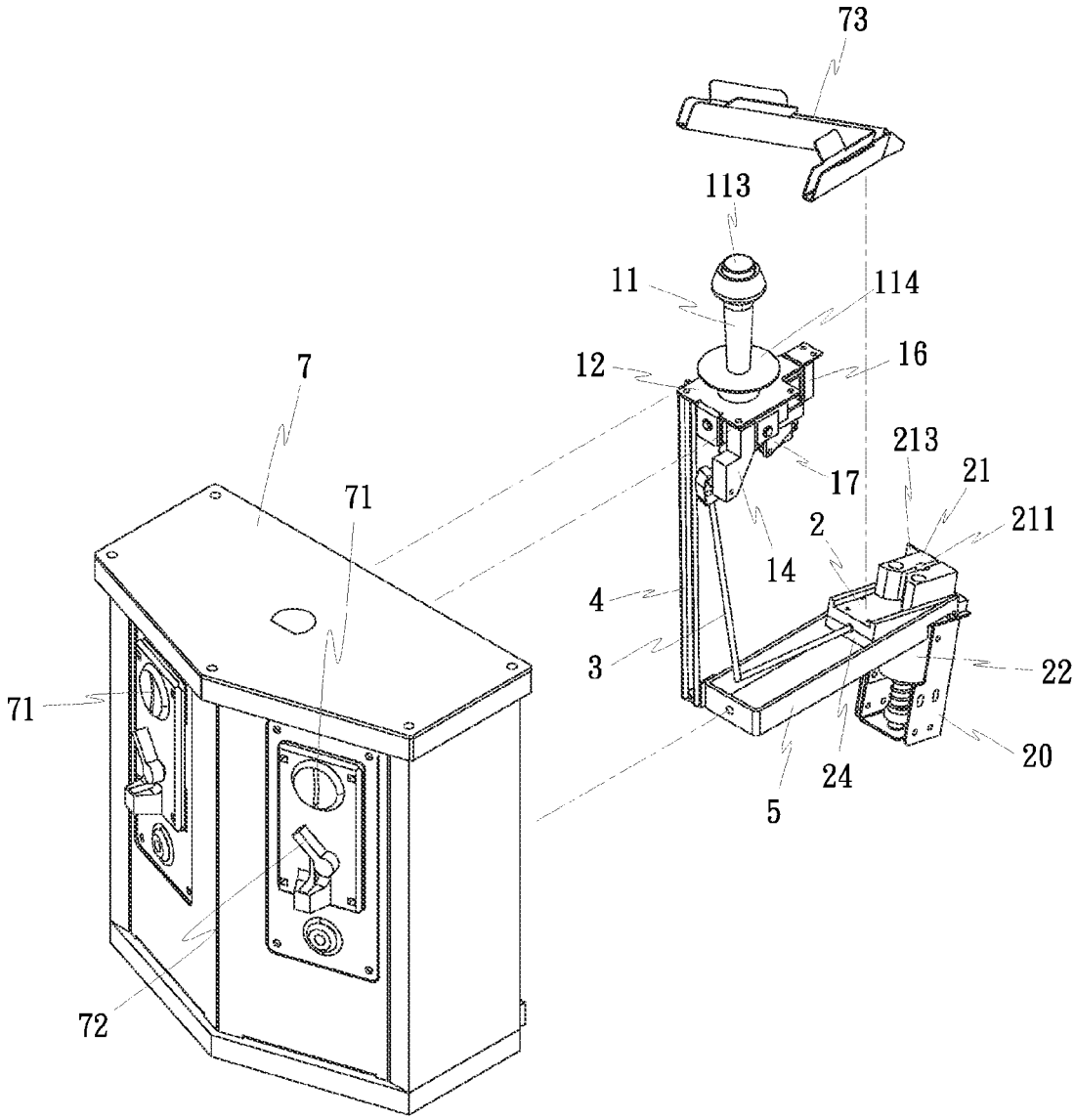
FIG. 2 is another exploded view of the thrower and the housing according to the present invention.
Figure 3:
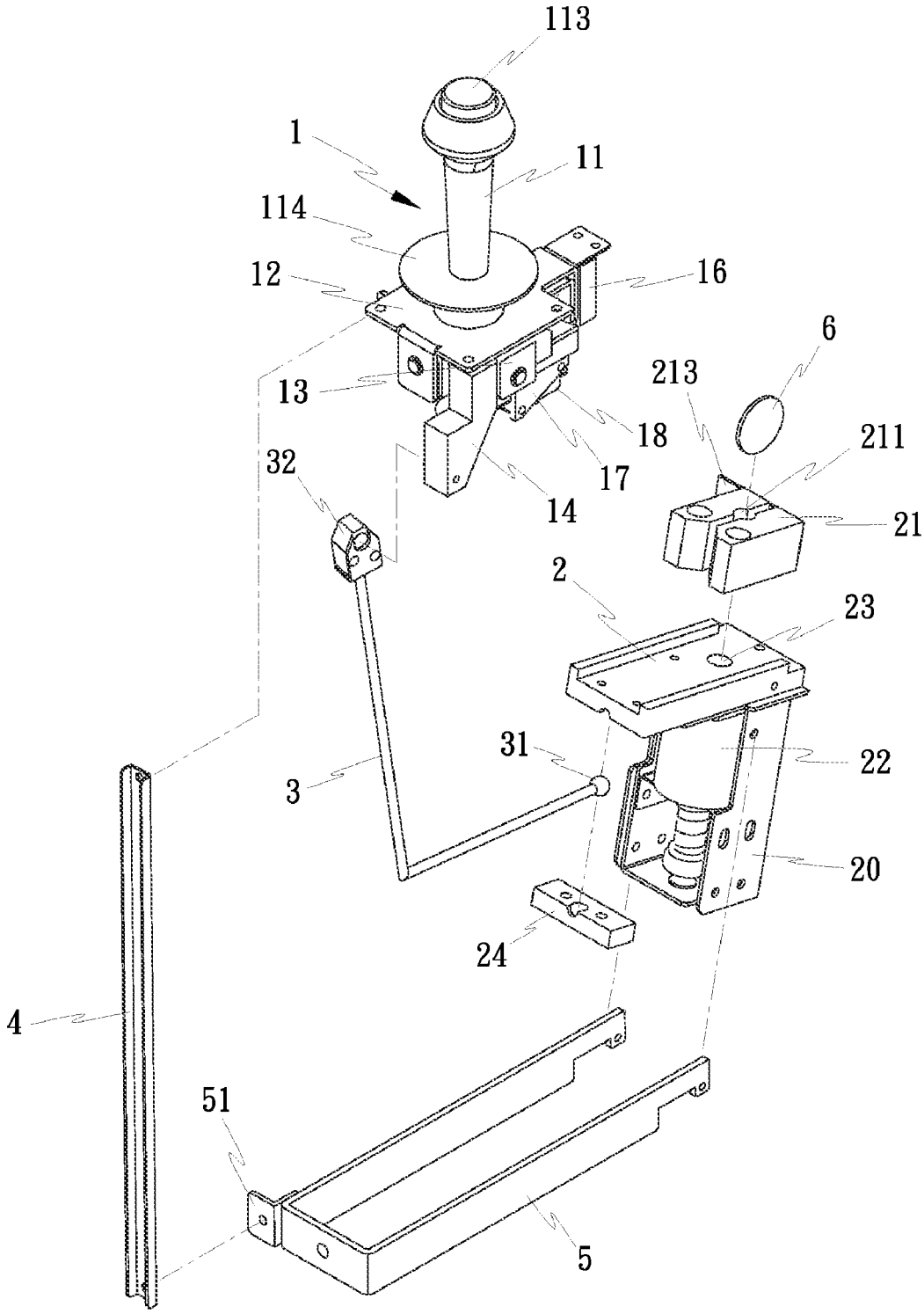
FIG. 3 is an exploded view of the thrower according to the present invention.

As shown in FIGS. 1-3, a thrower for game machine in accordance with the present invention comprises a joystick 1, a thrower holder 2, a tilting bar 3, a swinging bar 4 and a connection frame 5.

Figure 4:
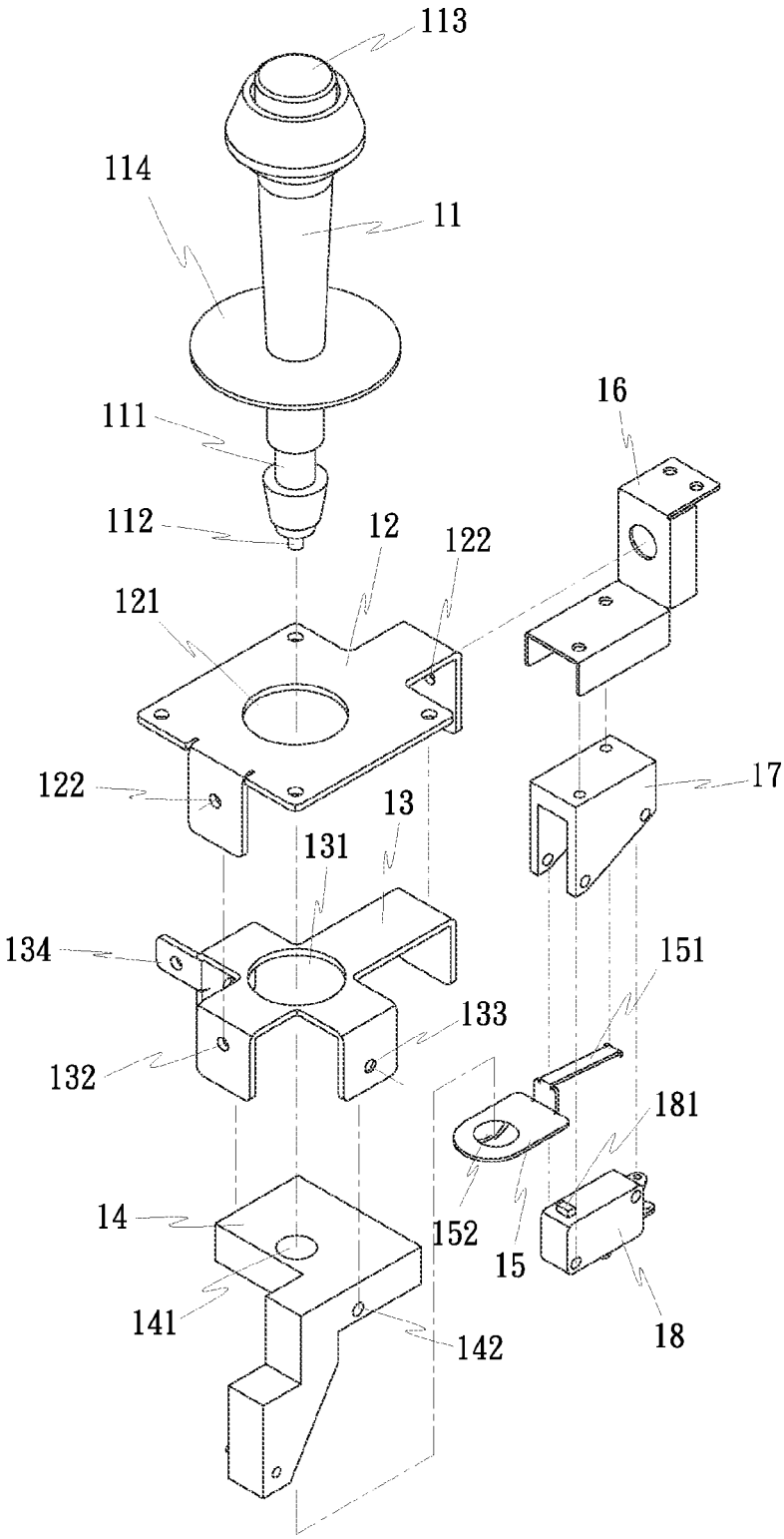
FIG. 4 is an exploded view of the joystick of the thrower according to the present invention.

The joystick 1, as shown in FIG. 4, comprises a stick 11 and a base, which is formed of a fixed plate 12, a movable plate 13, a displacement block 14 and an actuating plate 15. The stick 11 is inserted in proper order through the fixed plate 12, the movable plate 13 and the displacement block 14. The joystick 1 further comprises a locating frame 16 affixed to the fixed plate 12, a switch holder 17 affixed to the bottom wall of the locating frame 16 and an induction switch 18 mounted in the switch holder 17. The fixed plate 12, the movable plate 13 and the displacement block 14 each have a through hole 121, 131 and 141, respectively, for the passing of the stick 11. The stick 11 has a neck 111 coupled to the through hole 141 of the displacement block 14, an axially movable tip 112 disposed at the bottom side, and a control button 113 disposed at the top side and operable to move the tip 112. The fixed plate 12 has a pivot hole 122 located on each of the front and rear sides thereof in Y-axis direction. The displacement block 14 has a pivot hole 142 located on each of the left and right sides thereof in X-axis direction. The movable plate 13 has a pivot hole 132 located on each of the front and rear sides thereof in Y-axis direction and pivotally coupled to the pivot hole 122 of the fixed plate 12, a pivot hole 133 located on each of the left and right sides thereof in X-axis direction and respectively pivotally coupled to the pivot holes 142 on the displacement block 14. The actuating plate 15 is mounted in the switch holder 17, having an extension strip 151 disposed at one side for touching the triggering button 181 of the induction switch 18 and a concave bearing portion 152 disposed at the other side and vertically stopped against the tip 112 of the stick 11. The player can operate the control button 113 to control the extension and retraction of the tip 112. When the player presses the control button 113, the tip 112 is forced outwards against the concave bearing portion 152 of the actuating plate 15 to trigger the triggering button 181 of the induction switch 18, thereby turning on an electromagnetic valve 22 (this will be described further).

Figure 5:
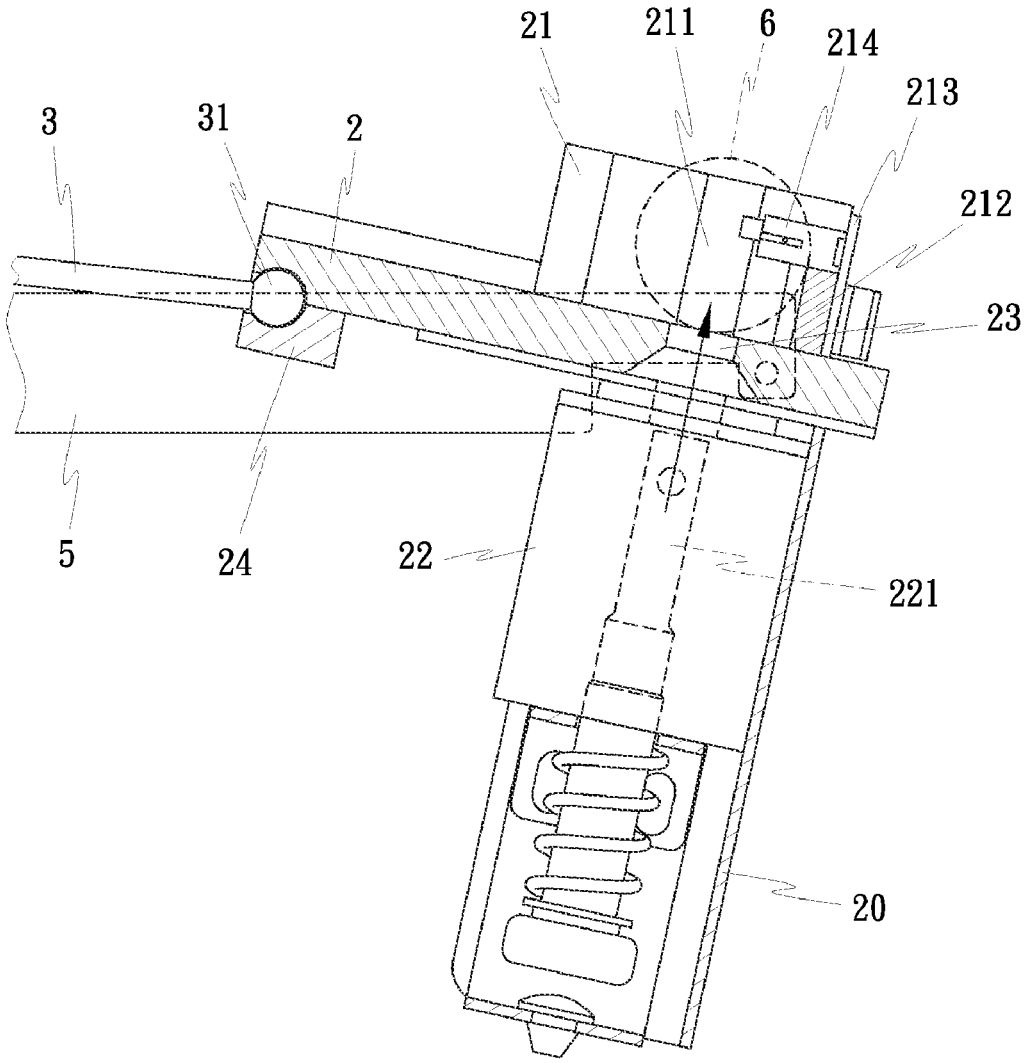
FIG. 5 is a schematic sectional view of the thrower holder of the thrower according to the present invention.

The thrower holder 2, as shown in FIG. 3, is pivotally coupled to the casing 20, having a through hole 23 cut through the top and bottom sides thereof, a guide block 21 fixedly mounted on the top side and an electromagnetic valve 22 mounted on the bottom side. The guide block 21 defines therein a retaining groove 211 in communication with the through hole 23 for holding an object to be thrown (for example, coin or token 6), having a stop member 212 disposed in the retaining groove 211 (see FIG. 5) and a substrate 213 mounted on the back side. The substrate 213 carries a sensor switch 214 adapted to detect the presence of a token 6 in the stand-by position. The electromagnetic valve 22 has a valve rod 221 insertable through the through hole 23 and the retaining groove 211 (see FIG. 5). Further, a ball socket 24 is provided at the front side of the thrower holder 2 to hold the tilting bar 3.

Figure 6:
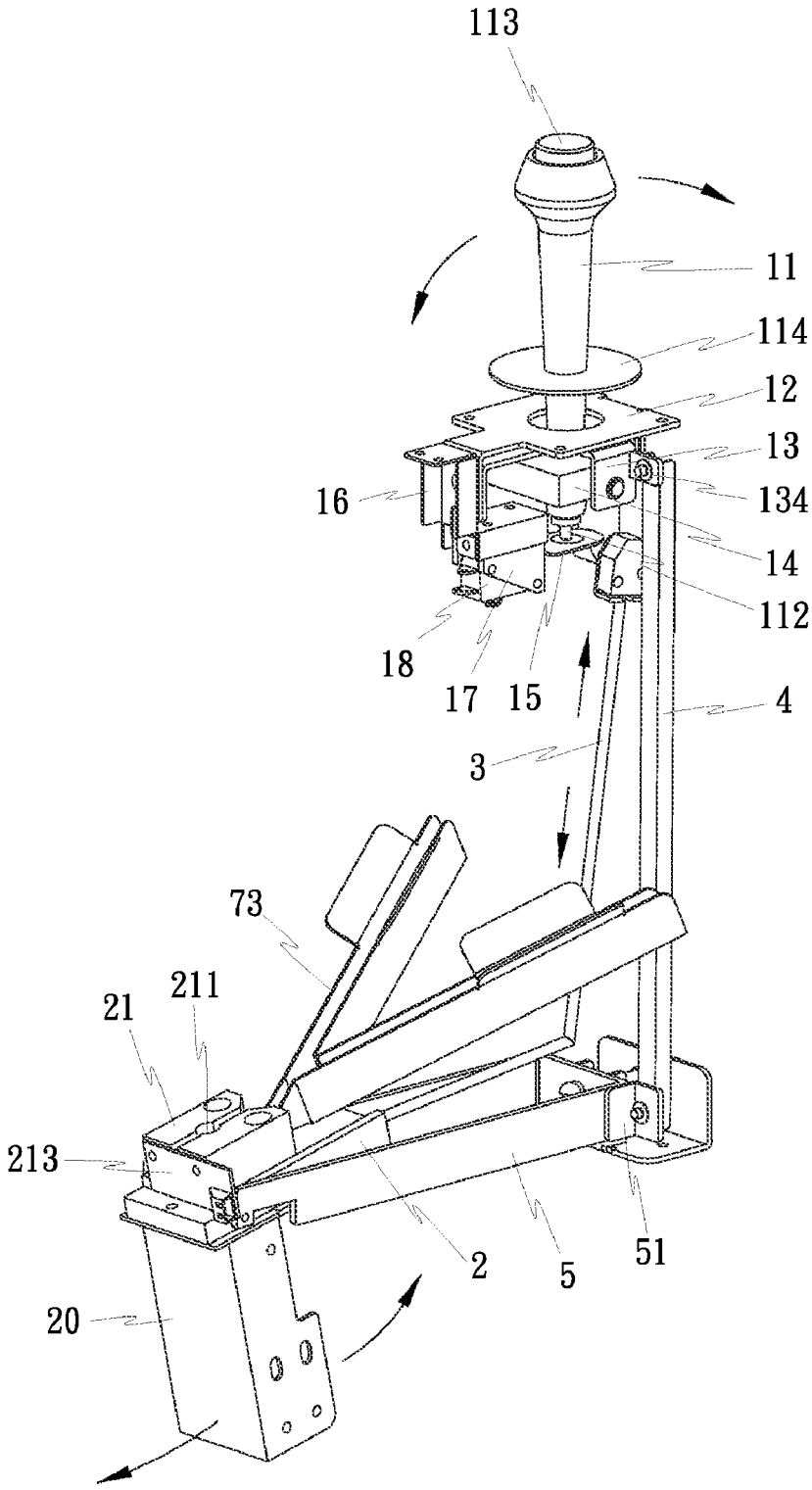
FIG. 6 is a schematic view of the thrower according to the present invention, showing the joystick of the thrower tilted back and forth.

The tilting bar 3, as shown in FIG. 3, has a ball 31 disposed at its one end and pivotally coupled to the ball socket 24 at the front side of the thrower holder 2 and a ball socket 32 disposed at its other end and pivotally coupled to the displacement block 14 of the joystick 1. According to the present preferred embodiment, the tilting bar 3 is an L-shaped bar. When the stick 11 of the joystick 1 is tilted back and forth (see FIG. 6), the displacement block 14 is driven to tilt the tilting bar 3, thereby lifting or lowering the thrower holder 2 to change the sloping angle of the guide block 21 as desired.

Figure 7:
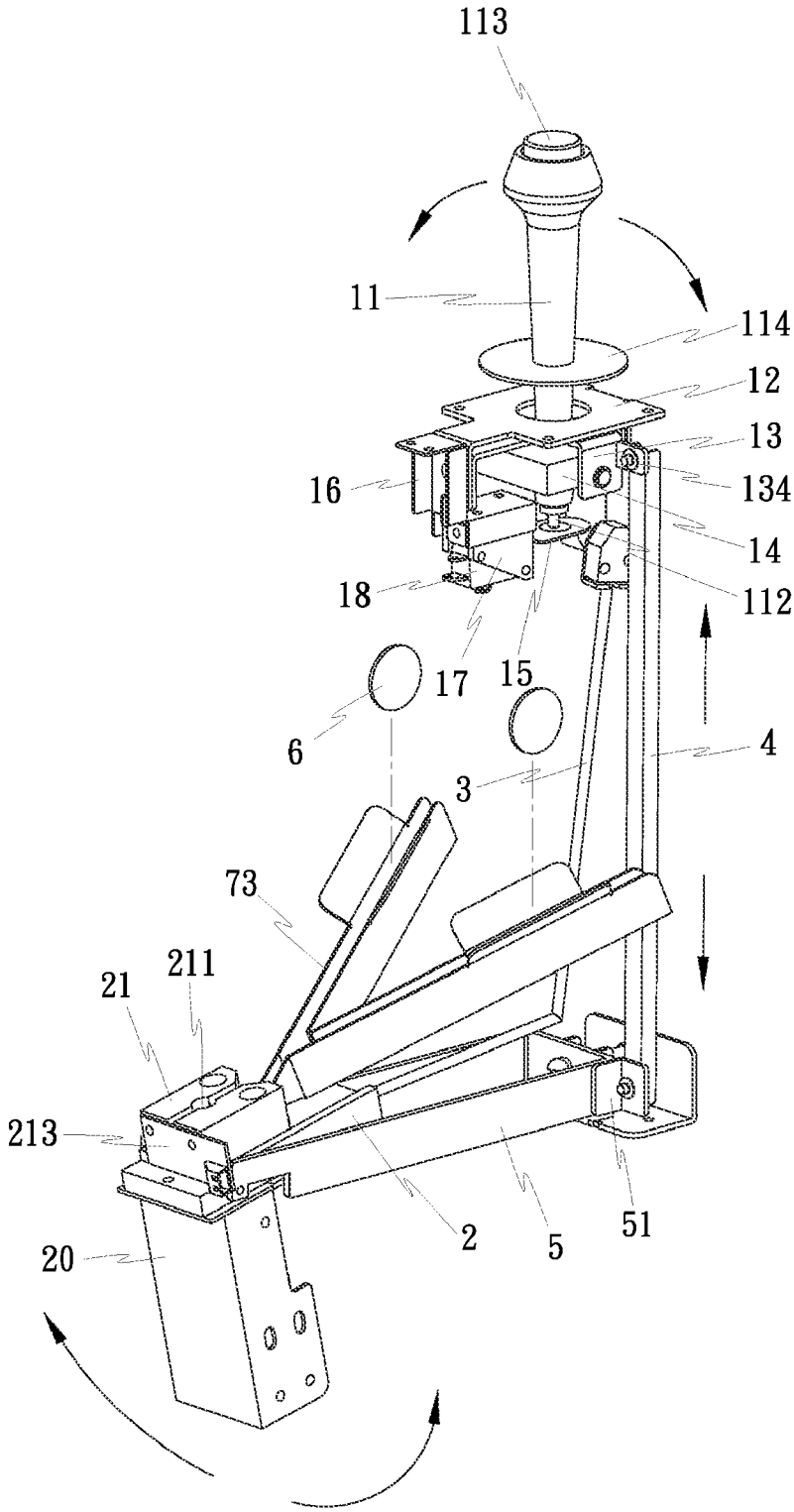
FIG. 7 is a schematic view of the thrower according to the present invention, showing the joystick of the thrower biased left and right.

The swinging bar 4 is a long straight bar having its one end pivotally coupled to a lug 134 at the movable plate 13 of the joystick 1 and its other end pivotally coupled to the connection frame 5. When the stick 11 of the joystick 1 is tilted leftwards or rightwards (see FIG. 7), the movable plate 13 is driven to bias the swinging bar 4, causing the connection frame 5 to bias the thrower holder 2 leftwards or rightwards.

The connection frame 5, as shown in FIG. 3, is a U-shaped frame bar pivotally coupled to the thrower holder 2, having a lug 51 disposed at its one side remote from the thrower holder 2 and pivotally coupled to the swinging bar 4. Therefore, when the player swings the swinging bar 4, the thrower holder 2 is synchronously biased.

Figure 8:
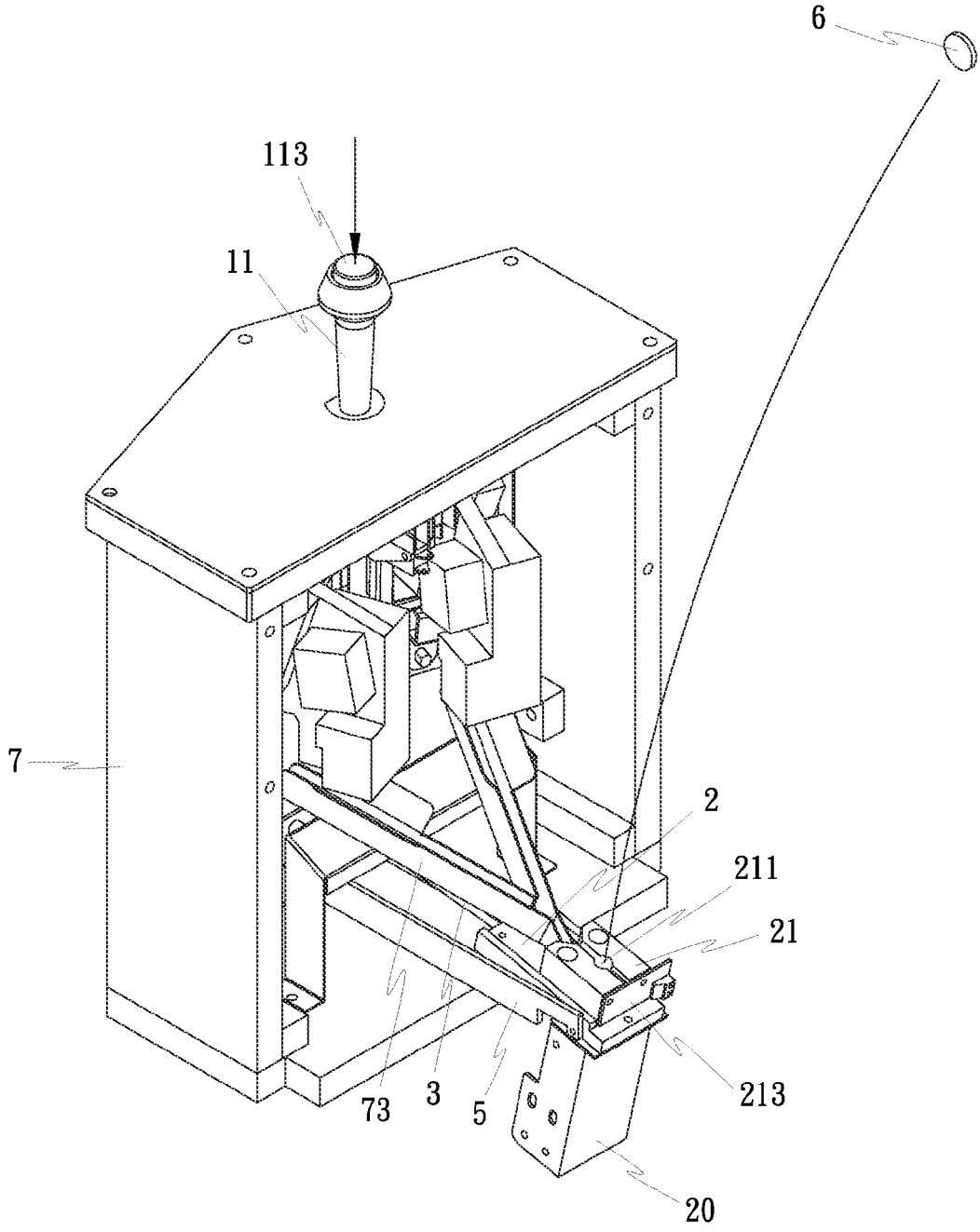
FIG. 8 is a schematic drawing of the present invention, showing the joystick of the thrower operated and a token thrown out of the thrower holder.

After the joystick 1, the thrower holder 2, the tilting bar 3, the swinging bar 4 and the connection frame 5 have been assembled to create a thrower, a coin or token 6 can be inserted into the retaining groove 211 of the thrower holder 2. After one coin or token 6 is inserted into the retaining groove 211 of the thrower holder 2, the player can tilt the stick 11 of the joystick 1 back and forth and/or left and right, causing the tilting bar 3 or the swinging bar 4 to tilt the thrower holder 2, thereby changing the sloping angle of the thrower holder 2 in the X-axis or Y-axis direction. After adjustment of the sloping angle of the thrower holder 2, the player can operate the joystick 1 to switch on the induction switch 18, causing the valve rod 221 of the electromagnetic valve 22 to strike the coin or token 6 away from the retaining groove 211 of the guide block 21 toward the desired direction (see FIG. 8). Thus, one throwing task is done.

Further, the thrower is accommodated in a housing 7 that has internal frame boards for the mounting of the component parts of the thrower. After installation, the stick 11 of the joystick 1 extends out of the housing 7. Further, a shading plate 114 is fixedly mounted on the periphery of the stick 11 and kept in proximity to the bottom surface of the top panel of the housing 7 to keep the inside of the housing 7 from sight. Further, the housing 7 has at least one coin slot 71 and a coin-return device 72. Further, the housing 7 has a track 73 located on the inside for guiding an inserted coin or token 6 from the coin slot 71 to the retaining groove 211 of the guide block 21 at the thrower holder 2 for throwing.

The structure of the joystick 1 is substantially similar to similar conventional designs, comprised of the aforesaid stick 11, fixed plate 12, movable plate 13, displacement block 14, actuating plate 15, locating frame 16, switch holder 17 and induction switch 18. Further, the arrangement of the tip 112 and control button 113 of the stick 11 is also of the known design. Therefore, no further detailed description of the joystick 1 is necessary. Further, other modifications and changes may be made to the joystick 1 without departing from the spirit and scope of the invention.

Figure 9:
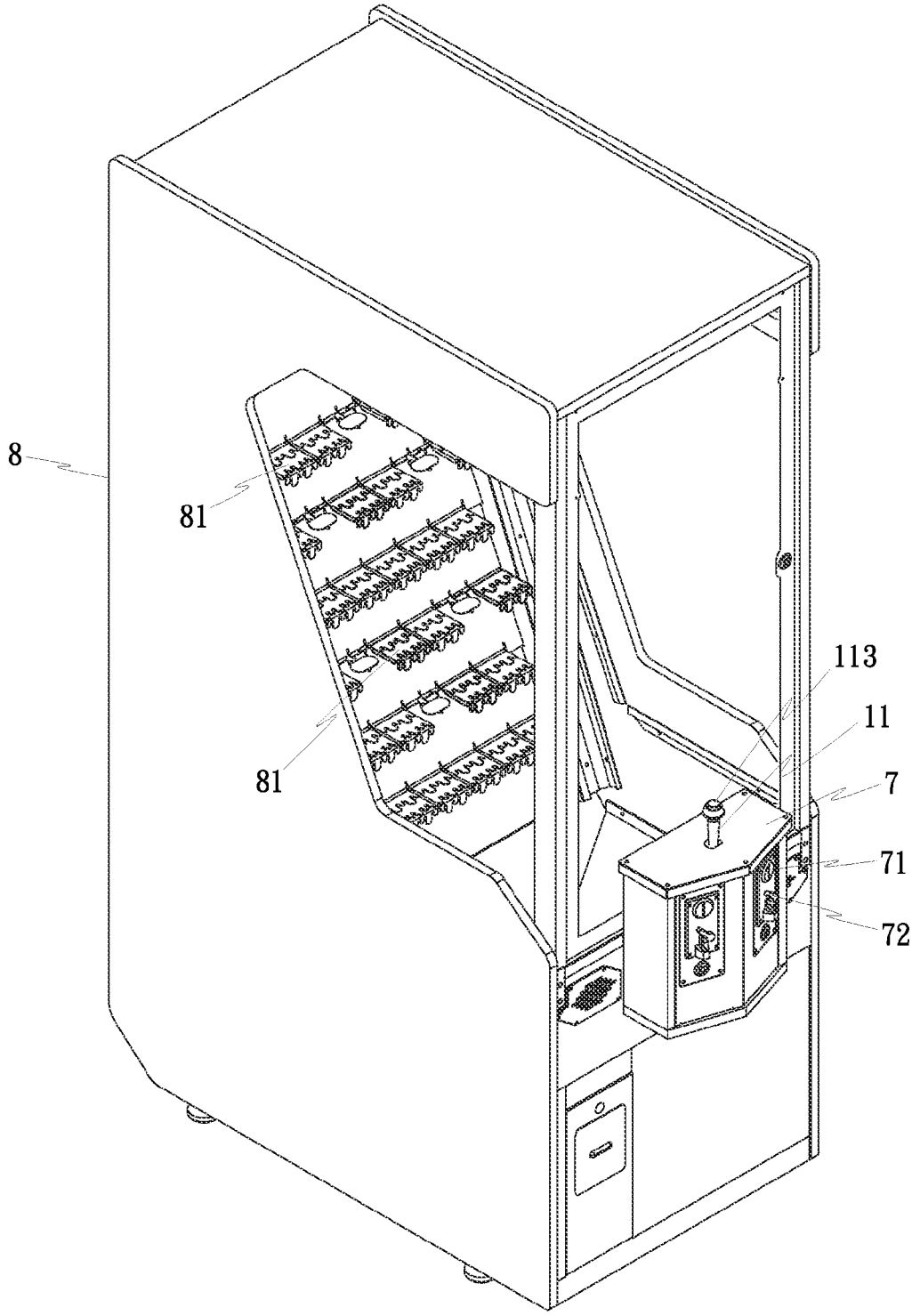
FIG. 9 illustrates an application of the present invention, showing the thrower installed in a coin-throwing game machine.

Referring to FIG. 9, the thrower is mounted with the housing 7 and used in a coin-throwing game machine 8, and operable to throw coins or tokens 6 onto carrier plates 81 in the coin-throwing game machine 8. When the weight of coins or tokens 6 accumulated on one carrier plate 81 surpasses a predetermined value, the carrier plate 81 will be turned over, causing the accumulated coins or tokens 6 to fall. Thus, the player can earn all the fallen coins or tokens 6 or an equivalent coupon as a prize. Therefore, the invention increases the level of difficulty of the game task and enhances the entertainment effect.

Figure 10:
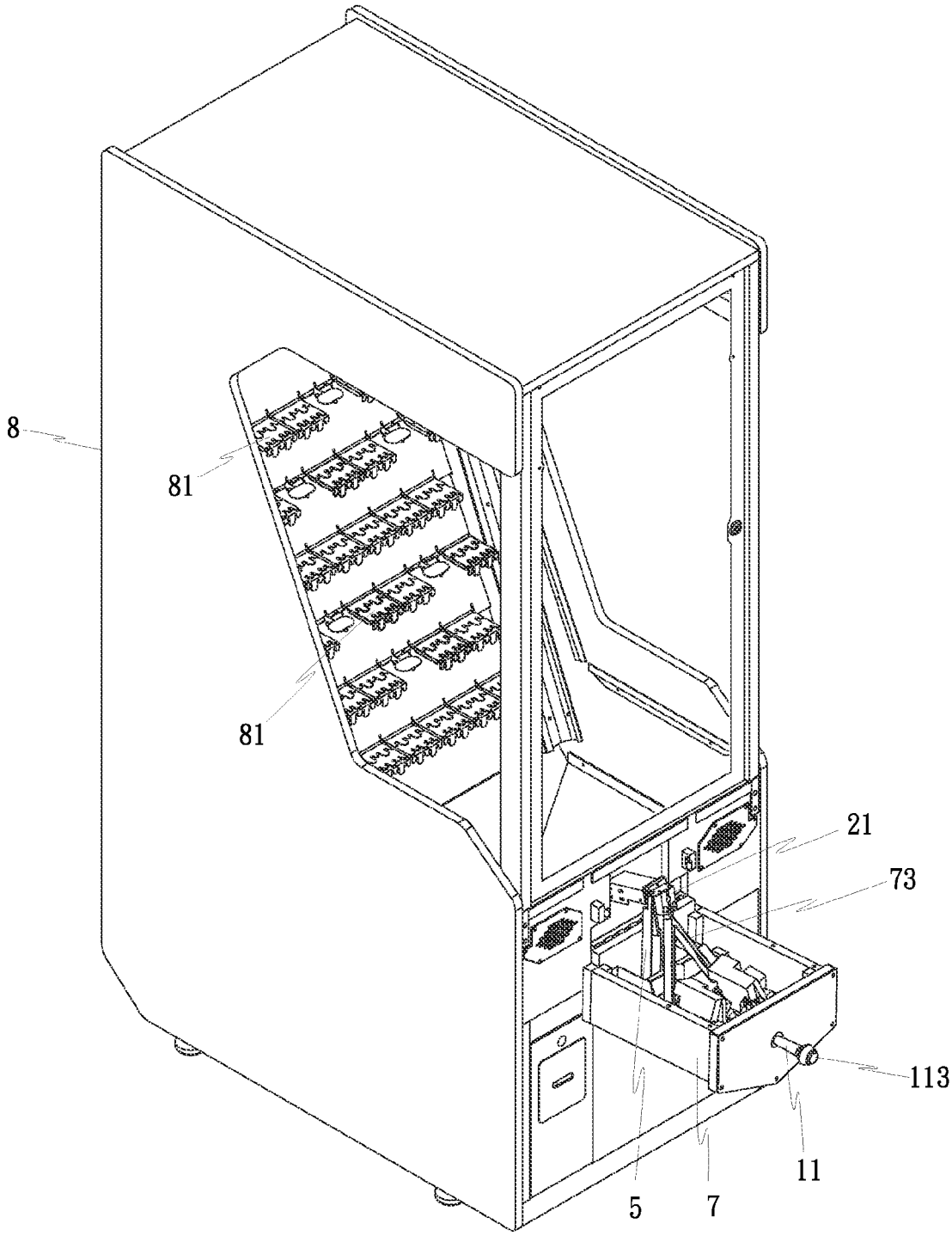
FIG. 10 corresponds to FIG. 9, showing the housing opened from the thrower.

Referring to FIG. 10, the housing 7 can be turned outwards relative to the thrower to facilitate maintenance. Sound and light generating circuit means may be installed in the coin-throwing game machine 8 to crease sound and light effects.

Further, the thrower of the present invention is not limited to the application for throwing coins or tokens 6. Alternatively, the thrower can be modified to change the design of the track 73 and the thrower holder 2 for throwing balls or any other objects.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A thrower used in a game machine, comprising a joystick, a thrower holder, a tilting bar, a swinging bar and a connection frame, wherein:

said joystick comprises a stick and a base, said base holding an induction switch at a bottom side thereof, said induction switch being controllable by said stick;

said thrower holder holds an electromagnetic valve on a bottom side thereof, said electromagnetic valve being controllable by said induction switch to throw an object away from said thrower holder;

said tilting bar is pivotally coupled between said joystick and said thrower holder and movable by said joystick to bias said thrower holder in a Y-axis direction;

said swinging bar is pivotally coupled between said joystick and said connection frame and movable by said joystick to bias said thrower holder in an X-axis direction; and said connection frame has one end thereof pivotally coupled to said swinging bar and an opposite end thereof pivotally coupled to said thrower holder.

2. The thrower as claimed in claim 1, wherein said base of said joystick comprises a fixed plate coupled to said stick, a movable plate coupled to said stick beneath said fixed plate, a displacement block coupled to said stick beneath said movable plate, a locating frame affixed to a rear side of said fixed plate, a switch holder affixed to a bottom side of said locating frame to hold said induction switch therein, and an actuating plate, said actuating plate having an extension strip disposed at one side thereof for triggering said induction switch and a bearing portion disposed at an opposite side thereof for driving by said stick to force said extension strip in triggering said induction switch.

3. The thrower as claimed in claim 2, wherein said fixed plate comprises a through hole cut through top and bottom sides thereof for the passing of said stick and a pivot hole located on each of front and rear sides thereof and disposed in the Y-axis direction; said movable plate comprises a through hole cut through top and bottom sides thereof for the passing of said stick, a first pivot hole located on each of front and rear sides thereof and disposed in the Y-axis direction and respectively pivotally coupled to the pivot holes of said fixed plate and a second pivot hole located on each of left and right sides thereof and disposed in the X-axis direction; said displacement block comprises a through hole cut through top and bottom sides thereof for the passing of said stick and a pivot hole located on each of left and right sides thereof and disposed in the X-axis direction and respectively pivotally coupled to the second pivot holes of said movable plate.

4. The thrower as claimed in claim 2, wherein the bearing portion of said actuating plate has a concave curvature.

5. The thrower as claimed in claim 1, wherein said thrower holder comprises a through hole cut through top and bottom sides thereof in vertical alignment with said electromagnetic valve, a guide block fixedly mounted on the top side and a casing pivotally connected to a rear side thereof for surrounding said electromagnetic valve, said guide block defining a retaining groove disposed in communication with the through hole of said thrower holder for holding an object for throwing by said electromagnetic valve.

6. The thrower as claimed in claim 5, wherein said guide block comprises a stop member disposed in said retaining groove, a substrate disposed at a rear side thereof, and a sensor means installed in said substrate and adapted for detecting the presence of an object in said retaining groove.

7. The thrower as claimed in claim 5, wherein said thrower holder comprises a ball socket located on a front side thereof; said tilting bar has a ball disposed at one end thereof and pivotally coupled to the ball socket at the front side of said thrower holder.

8. The thrower as claimed in claim 5, wherein said tilting bar has a ball socket disposed at one end thereof and pivotally coupled to the displacement block of the joystick; said displacement block of said joystick has a ball disposed at one side thereof and coupled to the ball socket of said tilting bar.

9. The thrower as claimed in claim 1, wherein said tilting bar is L-shaped.

10. The thrower as claimed in claim 5, further comprising a track connected to said thrower holder for guiding an object to said retaining groove of said guide block for throwing by said electromagnetic valve.

* * * * *